US005711713A

United States Patent [19]

Krueger

[11] Patent Number: 5,711,713

[45] Date of Patent: Jan. 27, 1998

[54] MODIFIED THEATRICAL COUNTERWEIGHT APPARATUS

[76] Inventor: Donald Krueger, P.O. Box 26203, Birmingham, Ala. 35260

[21] Appl. No.: 726,053

[22] Filed: Sep. 27, 1996

[51] Int. Cl.[6] ..... A63J 1/02

[52] U.S. Cl. ..... 472/77; 472/78

[58] Field of Search ..... 472/75, 77, 78, 472/79

[56] References Cited

U.S. PATENT DOCUMENTS

| | | | |
|---|---|---|---|
| 3,345,066 | 10/1967 | Izenour | 472/78 |
| 3,690,617 | 9/1972 | Butler | 472/78 |
| 4,662,628 | 5/1987 | Chatenay et al. | 472/77 |
| 4,795,405 | 1/1989 | Davis | 472/78 |

FOREIGN PATENT DOCUMENTS

| | | | |
|---|---|---|---|
| 1 429 314 | 3/1976 | United Kingdom | 472/77 |

*Primary Examiner*—Kien T. Nguyen
*Attorney, Agent, or Firm*—Michael I. Kroll

[57] ABSTRACT

A modified theatrical counterweight apparatus (10) in a double or single purchase counterweight system (12) consists of an improved counterweight arbor carriage (50), for holding a plurality of improved counterweights (56). The improved counterweights (56) are stored on two elongate arbor bars (48), which when released will slide down into the improved counterweight arbor carriage (50). The improved counterweight arbor carriage (50) when obtaining the proper amount of the improved counterweights (56), will now slide down the elongate arbor bars (48) to raise a piece of scenery (34) with a batten (36) up from a stage (14), via lift lines (38) and an operating line (42).

19 Claims, 5 Drawing Sheets

MODIFIED THEATRICAL COUNTERWEIGHT APPARATUS

BACKGROUND OF THE INVENTION

1. Field of the Invention

The instant invention relates generally to performing arts stages and more specifically it relates to a modified theatrical counterweight apparatus.

2. Description of the Prior Art

Numerous performing arts stages have been provided in prior art that are adapted to use a counterweight arbor, to raise and lower scenery, lighting and related stage equipment. While these units may be suitable for the particular purpose to which they address, they would not be as suitable for the purposes of the present invention as heretofore described.

SUMMARY OF THE INVENTION

A primary object of the present invention is to provide a modified theatrical counterweight apparatus that will overcome the shortcomings of the prior art devices.

Another object is to provide a modified theatrical counterweight apparatus that will eliminate the tedious and dangerous task of manually loading and unloading hundreds of old counterweights, stored on a catwalk, to and from an old counterweight arbor carriage, which raises and lowers scenery, lighting, etc. upon a stage.

An additional object is to provide a modified theatrical counterweight apparatus that will also considerably reduce the setup and tear down times of production on the stage, since new counterweight are now stored upon upper ends of two new elongate arbor bars, wherein the new counterweights can be quickly added into the new counterweight arbor carriage and removed from the new counterweight arbor carriage that travels along the new elongate arbor bars.

A further object is to provide a modified theatrical counterweight apparatus that is simple and easy to use.

A still further object is to provide a modified theatrical counterweight apparatus that is economical in cost to operate.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 8:
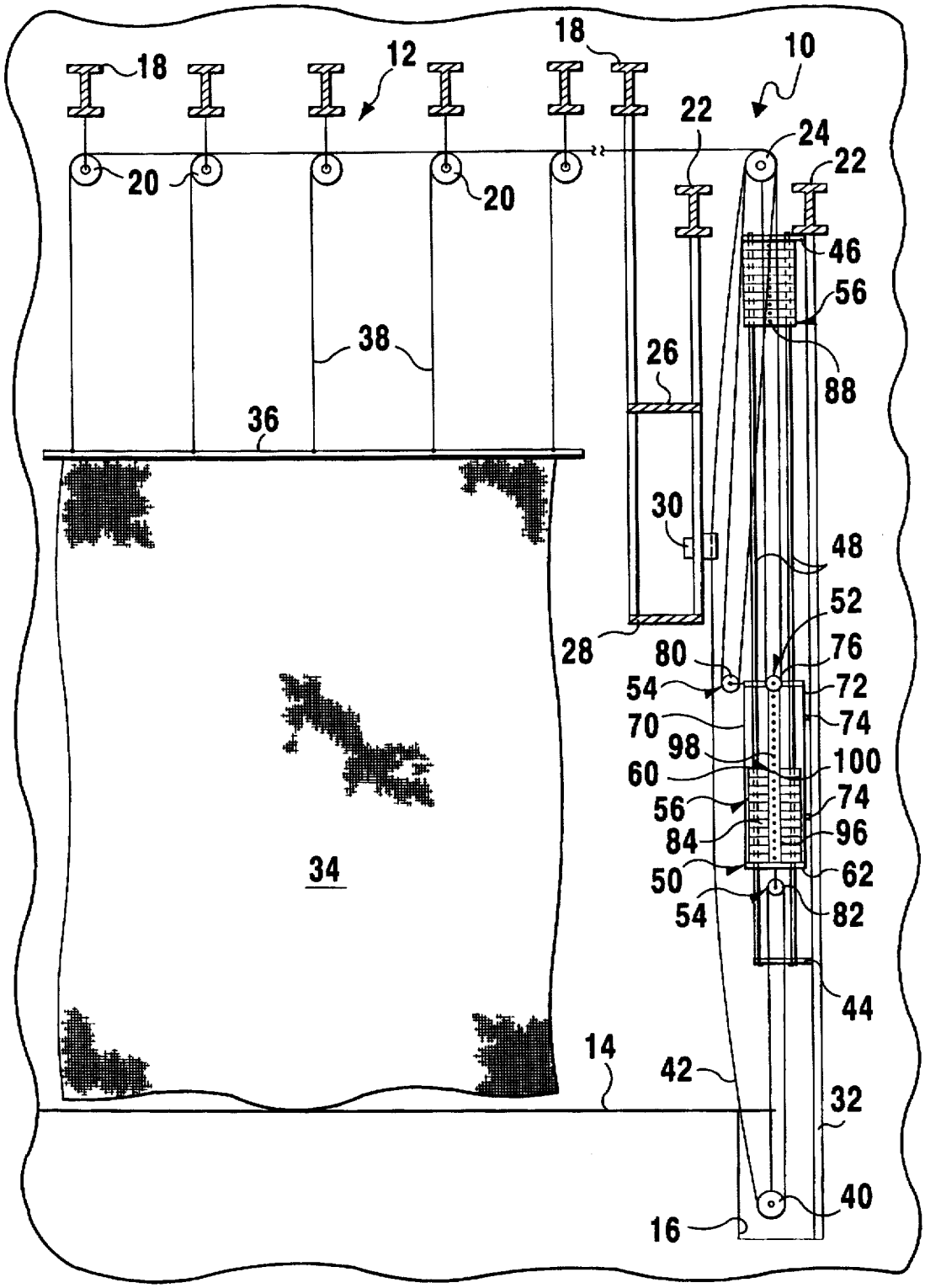
FIG. 8 is a diagrammatic front elevational view, similar to FIG. 1, showing the instant invention in place and in use in a new double purchase counterweight system.

Turning now descriptively to the drawings, in which similar reference characters denote similar elements throughout the several views, FIG. 8 illustrates a modified theatrical counterweight apparatus 10 in a double or single purchase counterweight system 12 for a stage 14 with a counterweight pit 16. The system 12 has a plurality of loft beams 18 over the stage 14. A plurality of loft beam sheaves 20 are underhung on the loft beams 18. Two head block beams 22 are over the counterweight pit 16. An upright head block sheive 24 is between the two head block beams 22. A loading gallery 26 above with an operating gallery below 28 is suspended vertically from one loft beam 18 and the first head block beam 22. A pin rail 30 is on the operating gallery 26. A pair of guide rails 32 extend vertically from the second head block beam 22 into the counterweight pit 16. A piece of scenery 34 with a batten 36 is suspended over the stage 14 by a plurality of lift lines 38 extending about the loft beam sheaves 20 and the upright head block sheive 24. A tensioning floating foot block sheive 40 is carried within the counterweight pit 16. An operating line 42 extends between the upright head block sheive 24, through the pin rail 30 and the tensioning foot block sheive 40.

The apparatus 10 comprises a bottom stop bracket 44 affixed at a right angle to the guide rails 32 above the counterweight pit 16. If the stage 14 does not have the counterweight pit 16, the bottom stop bracket 44 will be welded or bolted directly onto the floor of the stage 14. A top stop bracket 46 is affixed at a right angle to the guide rails 32 at the second head block beam 22. A pair of elongate arbor bars 48 extend vertically between the bottom stop bracket 44 and the top stop bracket 46. An improved counterweight arbor carriage 50 slides upon the elongate arbor bars 48 and the guide rails 32 between the bottom stop bracket 44 and the top stop bracket 46. Components 52 are for coupling the lift lines 38 to a top end of the improved counterweight arbor carriage 50 from the upright head block sheive 24. Elements 54 are for coupling the operating line 42 to the top end and a bottom end of the improved counterweight arbor carriage 50. A plurality of improved counterweights 56 are provided. A facility 58 is for storing some of the improved counterweights 56 on the elongate arbor bars 48 directly under the top stop bracket 46 and above the improved counterweight arbor carriage 50 until released. An assemblage 60 is for locking some of the improved counterweights 56 in the improved counterweight arbor carriage 50, after being released. The improved counterweights 56 will slide upon the elongate arbor bars 48, when the improved counterweight arbor carriage 50 raises the piece of scenery 34 with the batten 36 up from the stage 14.

Figure 5:
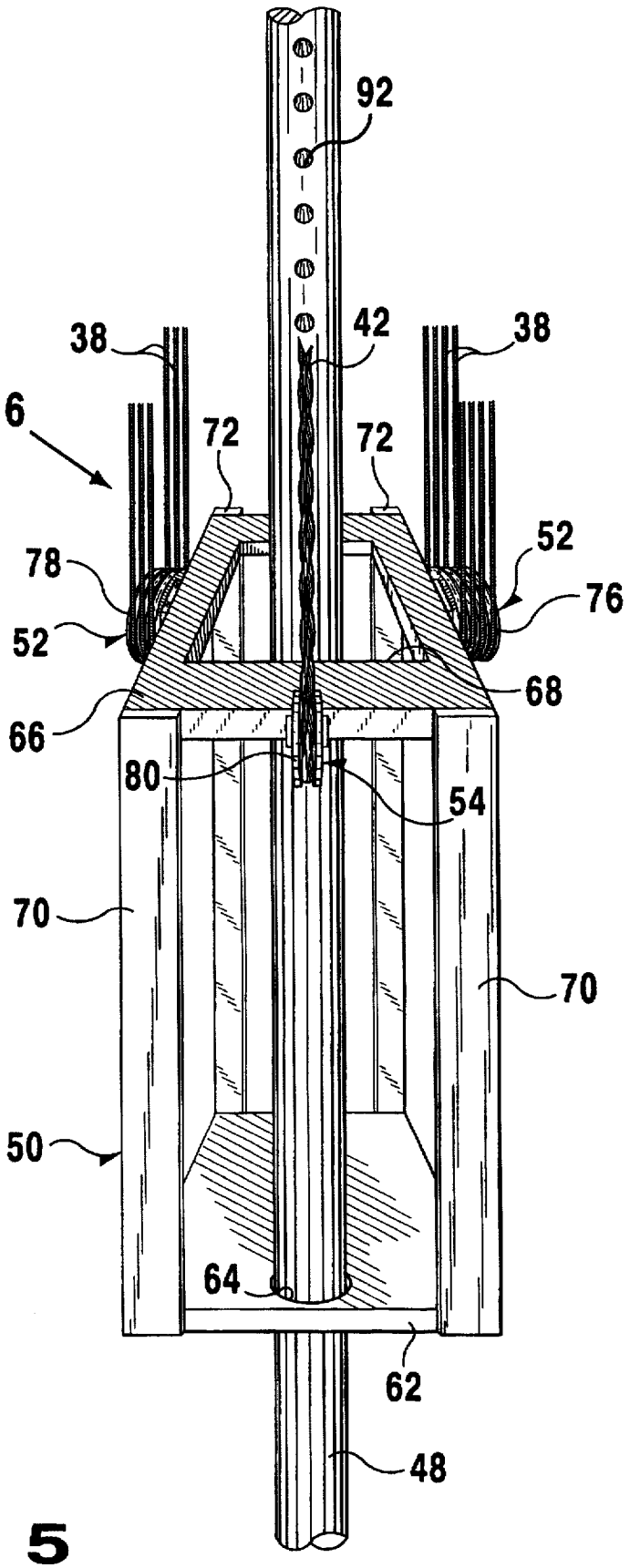
FIG. 5 is a front perspective view of the new counterweight arbor carriage with the new counterweights removed therefrom.
Figure 6:
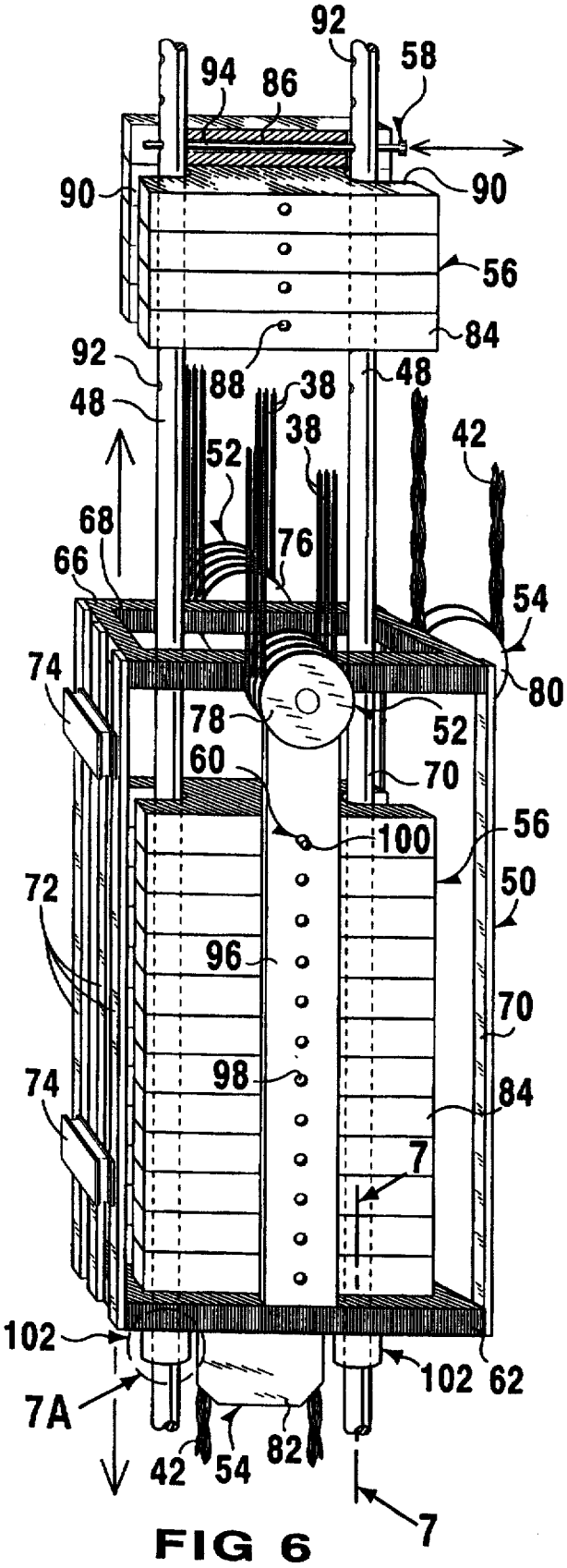
FIG. 6 is a rear perspective view taken in the direction of arrow 6 in FIG. 5, with some of the new counterweights stored on the elongate arbor bars and some of the new counterweights placed upon the new counterweight arbor carriage.

As best seen in FIGS. 5 and 6, the improved counterweight arbor carriage 50 includes a bottom plate 62 having a pair of spaced apart holes 64, to allow the elongate arbor bars 48 to extend therethrough. A top plate 66 is provided having a large rectangular aperture 68, to allow the improved counterweights 56 to pass therethrough on the elongate arbor bars 48. A plurality of front vertical support members 70 extend between a front end of the bottom plate 62 and the top plate 66. A plurality of rear vertical support members 72 extend between a rear end of the bottom plate 62 and the top plate 66. A pair of horizontal guide members 74 are transversely spaced apart and affixed to the rear vertical support members 72 to ride on the guide rails 32.

The lift lines coupling components 52 consist of a first lift sheive 76 mounted to a first side of the top plate 66 of the improved counterweight arbor carriage 50, to accommodate some of the lift lines 38. A second lift sheive 78 is mounted to a second side of the top plate 66 of the improved counterweight arbor carriage 50, to accommodate some of the lift lines 38.

The operating line coupling elements 54 are an operating sheive 80 mounted to a front end of the top plate 66 of the improved counterweight arbor carriage 50, to accommodate the operating line 42. A lower arbor sheive 82 is mounted centrally to a bottom surface of the bottom plate 62 of the improved counterweight arbor carriage 50, to also accommodate the operating line 42.

Figure 4:
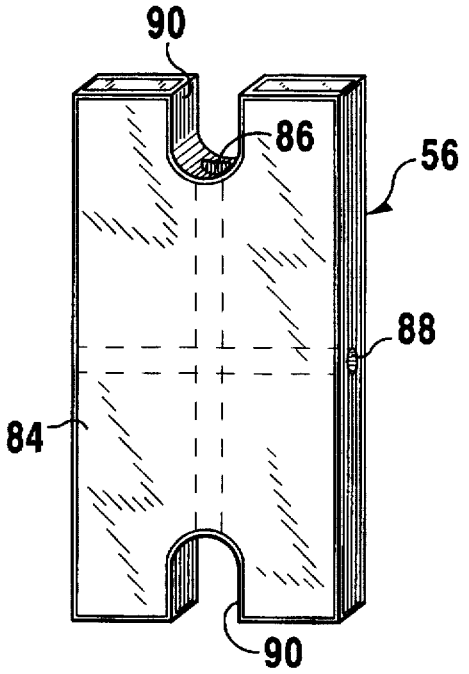
FIG. 4 is a perspective view, similar to FIG. 3, showing one of the new counterweights of the instant invention.

Each improved counterweight 56, as best seen in FIG. 4, includes a rectangular shaped block 84 having a long bore 86 extending between the center of the short sides thereof. A short bore 88 extends between the center of the long sides thereof. Each of the short sides has a slotted cavity 90, which straddle the elongate arbor bars 48.

The storing facility 58, as best seen in FIG. 6, consists of each elongate arbor bar 48 having a plurality of spaced apart holes 92 therethrough adjacent the top stop bracket 46. A plurality of locking pins 94 are provided. Each locking pin 94 can extend through the matching holes 92 in the elongate arbor bars 48 and the long bore 86 between the slotted cavities 90 in one rectangular shaped block 84 of the improved counterweight 56, to retain the improved counterweight 56 to the elongate arbor bars 48. When the lowest of the locking pins 94 is pulled out, the lowest improved counterweight 56 will drop down into the improved counterweight arbor carriage 50, to increase the weight thereof.

The locking assemblage 60, best shown in FIG. 6, comprises a pair of holding straps 96. Each holding strap 96 has a plurality of spaced apart holes 98 therethrough, which extends between a side end of the bottom plate 62 and the top plate 66 of the improved counterweight arbor carriage 50. A plurality of holding pins 100 are provided. Each holding pin 100 can extend through the matching holes 98 in the holding straps 96 and the short bore 88 in one rectangular shaped block 84 of the improved counterweight 56, to keep the improved counterweight 56 in a stationary position within the improved counterweight arbor carriage 50.

As shown in FIG. 6, a pair of grease cups 102 are welded to the bottom surface of the bottom plate 62 of the improved counterweight arbor carriage 50. Each grease cup 102 straddles one of the elongate arbor bars 48. When the improved counterweight arbor carriage 50 moves up and down, the elongate arbor bars 48 will be lubricated by the grease cups 102.

Figure 7A:
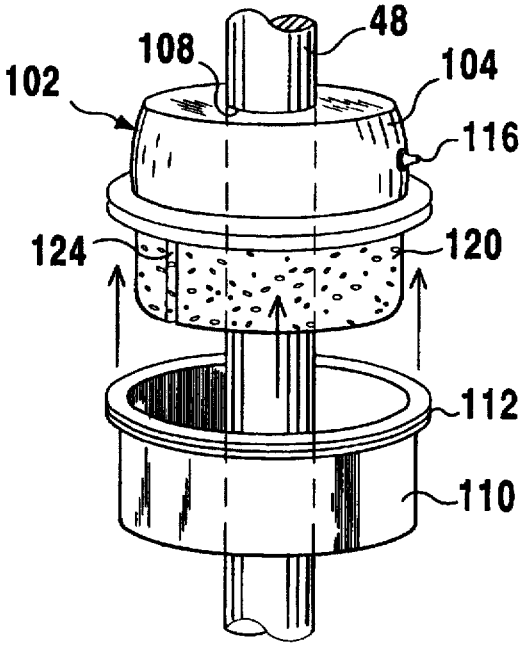
FIG. 7A is a partly exploded enlarged perspective view of one of the grease cups as indicated by arrow 7A in FIG. 6.
Figure 7:
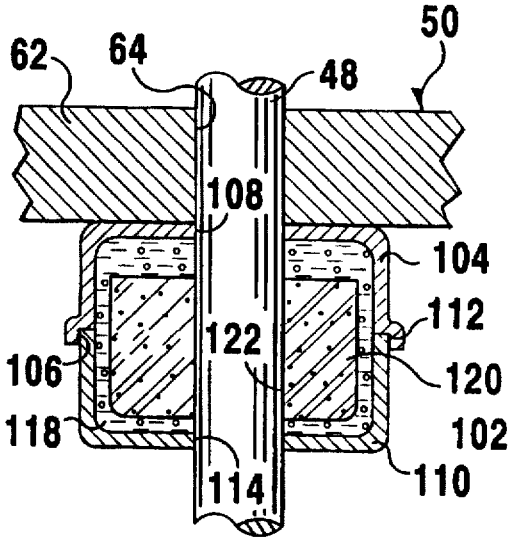
FIG. 7 is an enlarged cross sectional view taken along line 7—7 in FIG. 6, showing one of the grease cups in greater detail.

As best seen in FIGS. 7 and 7A, each grease cup 102 includes a cylindrical shaped cover 104 having internal threads 106 and a central aperture 108 therethrough. The cover 104 is welded to the bottom surface of the bottom plate 62 of the improved counterweight arbor carriage 50, to allow one elongate arbor bar 48 to pass through the central aperture 108. A cylindrical shaped container 110 has external threads 112 and a central orifice 114 therethrough. The container 110 is threaded to the cover 104, to allow one elongate arbor bar 48 to pass through the central orifice 114. An external grease fitting 116 is on the cover 104, so that grease 118 can be inserted into the cover 104, held in the container 110 and be applied onto the elongate arbor bar 48.

Each grease cup 102 can further include a cylindrical shaped sponge member 120, having a central hole 122 and a vertical slot 124 extending from the central hole 122. The sponge member 120 can be placed between the cover 104 and the container 110, about one elongate arbor bar 48 to hold the grease 118 and apply the grease 118 to the elongate arbor bar 48, when the improved counterweight arbor carriage 50 moves up and down.

Figure 1:
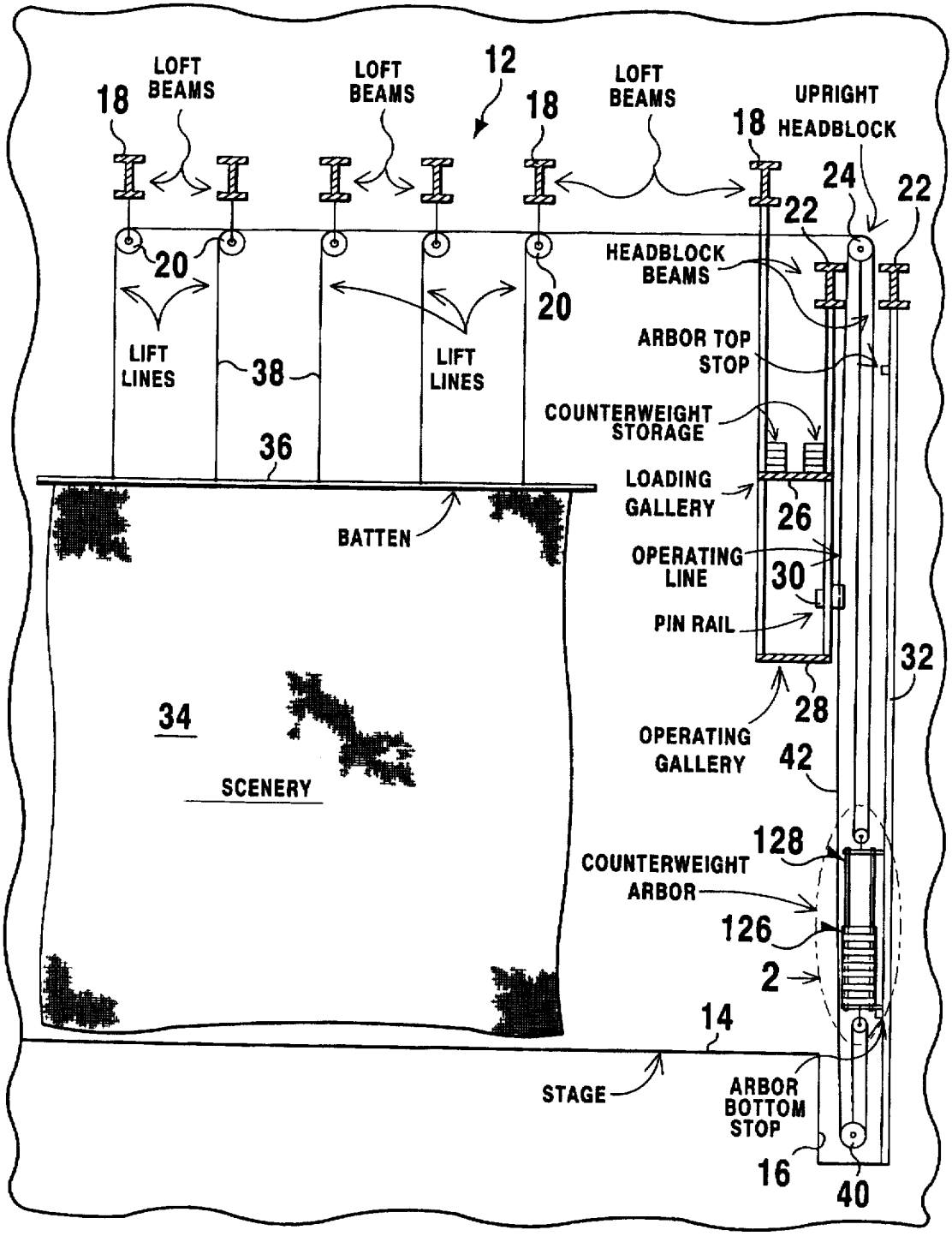
FIG 1 ( PRIOR ART)
FIG. 1 is prior art being a diagrammatic front elevational view with parts broken away and in section, of an old double purchase counterweight system.
Figure 2:
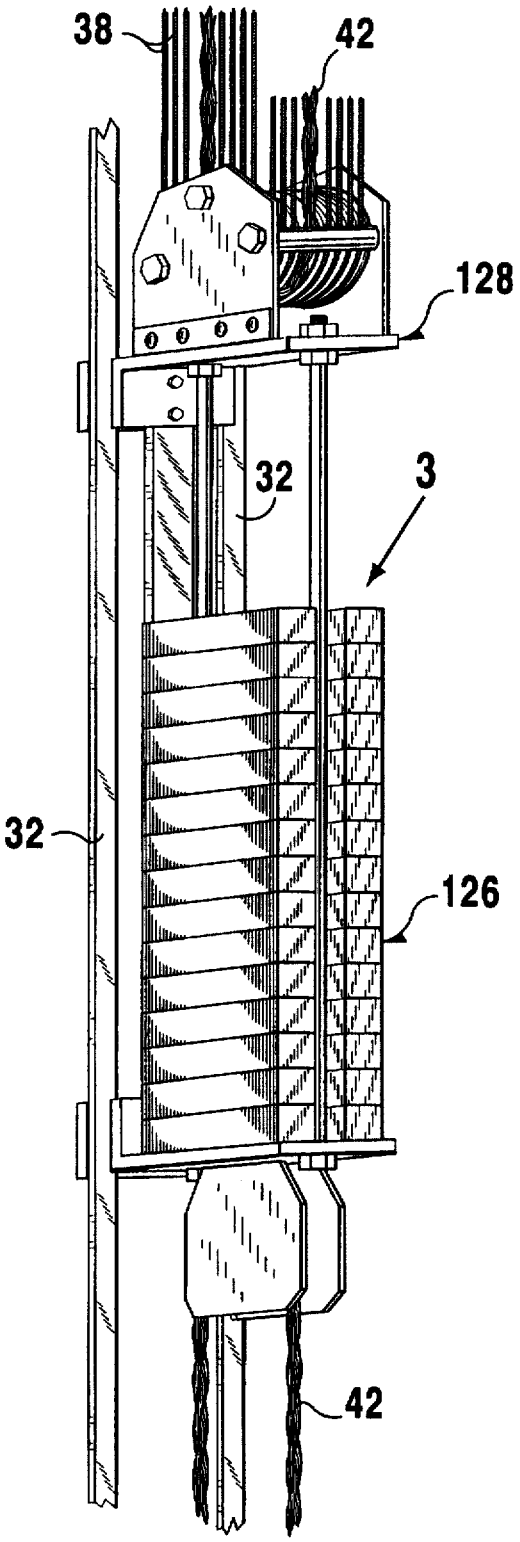
FIG 2 (PRIOR ART)
FIG. 2 is prior art being an enlarged perspective view of the area indicated by arrow 2 in FIG. 1, showing the old counterweight arbor carriage in greater detail.
Figure 3:
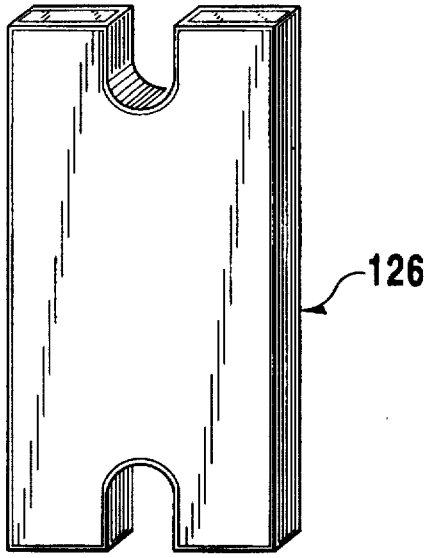
FIG 3 (PRIOR ART)
FIG. 3 is prior art being a further enlarged perspective view of one of the old counterweights taken in the direction of arrow 3 in FIG. 2.

The prior art shown in FIGS. 1 to 3, relates to the present system used in theaters, to raise and lower the piece of scenery 34, lighting, etc. There are two types of systems in use, single and double purchase systems. FIG. 1 is a diagram of the double purchase system 12. There are also variations on the locations of the components shown in FIG. 1. FIG. 1 is a general description of the components used in the double purchase system 12.

The prior art concerns itself exclusively with the loading and unloading of hundreds of counterweights 126, typically shown in FIG. 3, which is required in the setup and tear down of a production. These counterweights 126 are stored on catwalks, such as the loading gallery 26.

The piece of scenery 34, lighting, etc. is brought onto the stage 14. The batten 36 is lowered by raising the counterweight arbor carriage 128, as best seen in FIG. 2, to the loading gallery 26. The counterweight arbor carriage 128 always contains enough counterweights 126, to offset the weight of the batten 36 and the lift lines 38. This weight is referred to as the pipe weight. Technicians then start picking up the counterweights 126 and load them into the counterweight arbor carriage 128. This could involve several hundred pounds and some of the larger theaters have 50 to 75 counterweight arbor carriages 128.

LIST OF REFERENCE NUMBERS

10 modified theatrical counterweight apparatus
12 double purchase counterweight system
14 stage
16 counterweight pit in 14
18 loft beam of 12
20 loft beam sheive of 12 on 18
22 head block beam of 12
24 upright head block sheive of 12
26 loading gallery of 12
28 operating gallery of 12
30 pin rail on 28
32 guide rail between 22 and 16

34 piece of scenery of 12
36 batten on 34
38 lift line of 12
40 tensioning floating foot block sheive of 12 in 16
42 operating line of 12
44 bottom stop bracket of 10 on 32
46 top stop bracket of 10 on 32
48 elongate arbor bar of 10
50 improved counterweight arbor carriage of 10
52 lift lines coupling component of 10
54 operative line coupling element of 10
56 improved counterweight of 10
58 storing facility of 10
60 locking assemblage of 10
62 bottom plate of 50
64 hole in 62 for 48
66 top plate of 50
68 large rectangular aperture in 66
70 front vertical support member of 50
72 rear vertical support member of 50
74 horizontal guide member of 50
76 first lift sheive of 52
78 second lift sheive of 52
80 operating sheive of 54
82 lower arbor sheive of 54
84 rectangular shaped block of 56
86 long bore in 84
88 short bore in 84
90 slotted cavity in 84
92 hole in 48 of 58
94 locking pin of 58
96 holding strap of 60
98 hole in 96
100 holding pin of 60
102 grease cup of 10
104 cylindrical shaped cover of 102
106 internal threads in 104
108 central aperture in 104
110 cylindrical shaped container of 102
112 external threads on 110
114 central orifice in 110
116 external grease fitting on 104
118 grease in 104 and 110
120 cylindrical shaped sponge member of 102
122 central hole in 120
124 vertical slot in 120
126 prior art counterweight
128 prior art counterweight arbor carriage It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A modified theatrical counterweight apparatus in a double or single purchase counterweight system for a stage with a counterweight pit, the system having a plurality of loft beams over the stage, a plurality of loft beam sheaves underhung on the loft beams, two head block beams over the counterweight pit, an upright head block sheive between the two head block beams, a loading gallery above with an operating gallery below suspended vertically from one loft beam and the first head block beam, a pin rail on the operating gallery, a pair of guide rails extending vertically from the second head block beam into the counterweight pit, a piece of scenery with a batten suspended over the stage by a plurality of lift lines extending about the loft beam sheaves and the upright head block sheive, a tensioning floating foot block sheive carried within the counterweight pit, and an operating line extending between the upright head block sheive through the pin rail and the tensioning floating foot block sheive, said apparatus comprising:

a) a bottom stop bracket affixed at a right angle to the guide rails above the counterweight pit;

b) a top stop bracket affixed at a right angle to the guide rails at the second head block beam;

c) a pair of elongate arbor bars extending vertically between said bottom stop bracket and said top stop bracket;

d) an improved counterweight arbor carriage which slides upon said elongate arbor bars and the guide rails between said bottom stop bracket and said top stop bracket;

e) means for coupling the lift lines to a top end of said improved counterweight arbor carriage from the upright head block sheive;

f) means for coupling the operating line to the top end and a bottom end of said improved counterweight arbor carriage;

g) a plurality of improved counterweights;

h) means for storing some of said improved counterweights on said elongate arbor bars directly under said top stop bracket and above said improved counterweight arbor carriage until released; and i) means for locking some of said improved counterweights in said improved counterweight arbor carriage, after being released, whereby said improved counterweights will slide upon said elongate arbor bars when said improved counterweight arbor carriage raises the piece of scenery with said batten up from the stage.

2. A modified theatrical counterweight apparatus as recited in claim 1, wherein said improved counterweight arbor carriage includes:

a) a bottom plate having a pair of spaced apart holes, to allow said elongate arbor bars to extend therethrough;

b) a top plate having a large rectangular aperture, to allow said improved counterweights to pass therethrough on said elongate arbor bars;

c) a plurality of front vertical support members extending between a front end of said bottom plate and said top plate;

d) a plurality of rear vertical support members extending between a rear end of said bottom plate and said top plate; and e) a pair of horizontal guide members transversely spaced apart and affixed to said rear vertical support members to ride on the guide rails.

3. A modified theatrical counterweight apparatus as recited in claim 2, wherein said lift lines coupling means includes:

a) a first lift sheive mounted to a first side of said top plate of said improved counterweight arbor carriage, to accommodate some of the lift lines; and b) a second lift sheive mounted to a second side of said top plate of said improved counterweight arbor carriage, to accommodate some of the lift lines.

4. A modified theatrical counterweight apparatus as recited in claim 2, wherein said operating line coupling means includes:

a) an operating sheive mounted to a front end of said top plate of said improved counterweight arbor carriage, to accommodate the operating line; and b) a lower arbor sheive mounted centrally to a bottom surface of said bottom plate of said improved counterweight arbor carriage, to also accommodate the operating line.

5. A modified theatrical counterweight apparatus as recited in claim 2, wherein each said improved counterweight includes a rectangular shaped block having a long bore extending between the center of the short sides thereof, a short bore extending between the center of the long sides thereof and each of the short sides having a slotted cavity which straddle said elongate arbor bars.

6. A modified theatrical counterweight apparatus as recited in claim 5, wherein said storing means includes:

a) each said elongate arbor bar having a plurality of spaced apart holes therethrough adjacent said top stop bracket; and b) a plurality of locking pins, whereby each said locking pin can extend through said matching holes in said elongate arbor bars and said long bore between said slotted cavities in one said rectangular shaped block of said improved counterweight to retain said improved counterweight to said elongate arbor bars, whereby when the said lowest of said locking pins is pulled out, said lowest improved counterweight will drop down into said improved counterweight arbor carriage to increase the weight thereof.

7. A modified theatrical counterweight apparatus as recited in claim 5, wherein said locking means includes:

a) a pair of holding straps, each said holding strap having a plurality of spaced apart holes therethrough, which extends between a side end of said bottom plate and said top plate of said improved counterweight arbor carriage; and b) a plurality of holding pins, whereby each said holding pin can extend through said matching holes in said holding straps and said short bore in one said rectangular shaped block of said improved counterweight, to keep said improved counterweight in a stationary position within said improved counterweight arbor carriage.

8. A modified theatrical counterweight apparatus as recited in claim 2, further including a pair of grease cups welded to the bottom surface of said bottom plate of said improved counterweight arbor carriage, whereby each said grease cup straddles one of said elongate arbor bars, so that when said improved counterweight arbor carriage moves up and down, said elongate arbor bars will be lubricated by said grease cups.

9. A modified theatrical counterweight apparatus as recited in claim 8, wherein each said grease cup includes:

a) a cylindrical shaped cover having internal threads and a central aperture therethrough, said cover being welded to the bottom surface of said bottom plate of said improved counterweight arbor carriage, to allow one said elongate arbor bar to pass through said central aperture;

b) a cylindrical shaped container having external threads and a central orifice therethrough, said container threaded to said cover, to allow one said elongate arbor bar to pass through said central orifice; and c) an external grease fitting on said cover, so that grease can be inserted into said cover, held in said container and be applied onto said elongate arbor bar.

10. A modified theatrical counterweight apparatus as recited in claim 9, wherein each said shaped cup further includes a cylindrical shaped sponge member having a central hole and a vertical slot extending from said central hole, so that said sponge member can be placed between said cover and said container, about one said elongate arbor bar to hold the grease and apply the grease to said elongate arbor bar, when said improved counterweight arbor carriage moves up and down.

11. A modified theatrical counterweight apparatus in a double or single purchase counterweight system for a stage with a counterweight pit, the system having a plurality of loft beams over the stage, a plurality of loft beam sheaves underhung on the loft beams, two head block beams over the counterweight pit, an upright head block sheive between the two head block beams, a loading gallery above with an operating gallery below suspended vertically from one loft beam and the first head block beam, a pin rail on the operating gallery, a pair of guide rails extending vertically from the second head block beam into the counterweight pit, a piece of scenery with a batten suspended over the stage by a plurality of lift lines extending about the loft beam sheaves and the upright head block sheive, a tensioning floating foot block sheive carried within the counterweight pit, and an operating line extending between the upright head block sheive through the pin rail and the tensioning floating foot block sheive, said apparatus comprising:

a) a bottom stop bracket affixed at a right angle to the guide rails above the counterweight pit;

b) a top stop bracket affixed at a right angle to the guide rails at the second head block beam;

c) a pair of elongate arbor bars extending vertically between said bottom stop bracket and said top stop bracket;

d) an improved counterweight arbor carriage which slides upon said elongate arbor bars and the guide rails between said bottom stop bracket and said top stop bracket, wherein said improved counterweight arbor carriage includes a bottom plate having a pair of spaced apart holes, to allow said elongate arbor bars to extend therethrough, a top plate having a large rectangular aperture, to allow said improved counterweights to pass therethrough on said elongate arbor bars, a plurality of front vertical support members extending between a front end of said bottom plate and said top plate, a plurality of rear vertical support members extending between a rear end of said bottom plate and said top plate and a pair of horizontal guide members transversely spaced apart and affixed to said rear vertical support members to ride on the guide rails;

e) means for coupling the lift lines to a top end of said improved counterweight arbor carriage from the upright head block sheive;

f) means for coupling the operating line to the top end and a bottom end of said improved counterweight arbor carriage;

g) a plurality of improved counterweights;

h) means for storing some of said improved counterweights on said elongate arbor bars directly under said top stop bracket and above said improved counterweight arbor carriage until released; and i) means for locking some of said improved counterweights in said improved counterweight arbor carriage, after being released, whereby said improved counterweights will slide upon said elongate arbor bars when said improved counterweight arbor carriage raises the piece of scenery with said batten up from the stage.

12. A modified theatrical counterweight apparatus as recited in claim 11, wherein said lift lines coupling means includes:

a) a first lift sheive mounted to a first side of said top plate of said improved counterweight arbor carriage, to accommodate some of the lift lines; and b) a second lift sheive mounted to a second side of said top plate of said improved counterweight arbor carriage, to accommodate some of the lift lines.

13. A modified theatrical counterweight apparatus as recited in claim 12, wherein said operating line coupling means includes:

a) an operating sheive mounted to a front end of said top plate of said improved counterweight arbor carriage, to accommodate the operating line; and b) a lower arbor sheive mounted centrally to a bottom surface of said bottom plate of said improved counterweight arbor carriage, to also accommodate the operating line.

14. A modified theatrical counterweight apparatus as recited in claim 13, wherein each said improved counterweight includes a rectangular shaped block having a long bore extending between the center of the short sides thereof, a short bore extending between the center of the long sides thereof and each of the short sides having a slotted cavity which straddle said elongate arbor bars.

15. A modified theatrical counterweight apparatus as recited in claim 14, wherein said storing means includes:

a) each said elongate arbor bar having a plurality of spaced apart holes therethrough adjacent said top stop bracket; and b) a plurality of locking pins, whereby each said locking pin can extend through said matching holes in said elongate arbor bars and said long bore between said slotted cavities in one said rectangular shaped block of said improved counterweight to retain said improved counterweight to said elongate arbor bars, whereby when said lowest of said locking pins is pulled out, said lowest improved counterweight will drop down into said improved counterweight arbor carriage to increase the weight thereof.

16. A modified theatrical counterweight apparatus as recited in claim 15, wherein said locking means includes:

a) a pair of holding straps, each said holding strap having a plurality of spaced apart holes therethrough, which extends between a side end of said bottom plate and said top plate of said improved counterweight arbor carriage; and b) a plurality of holding pins, whereby each said holding pin can extend through said matching holes in said holding straps and said short bore in one said rectangular shaped block of said improved counterweight, to keep said improved counterweight in a stationary position within said improved counterweight arbor carriage.

17. A modified theatrical counterweight apparatus as recited in claim 16, further including a pair of grease cups welded to the bottom surface of said bottom plate of said improved counterweight arbor carriage, whereby each said grease cup straddles one of said elongate arbor bars, so that when said improved counterweight arbor carriage moves up and down, said elongate arbor bars will be lubricated by said grease cups.

18. A modified theatrical counterweight apparatus as recited in claim 17, wherein each said grease cup includes:

a) a cylindrical shaped cover having internal threads and a central aperture therethrough, said cover being welded to the bottom surface of said bottom plate of said improved counterweight arbor carriage, to allow one said elongate arbor bar to pass through said central aperture;

b) a cylindrical shaped container having external threads and a central orifice therethrough, said container threaded to said cover, to allow one said elongate arbor bar to pass through said central orifice; and c) an external grease fitting on said cover, so that grease can be inserted into said cover, held in said container and be applied onto said elongate arbor bar.

19. A modified theatrical counterweight apparatus as recited in claim 18, wherein each said grease cup further includes a cylindrical shaped sponge member having a central hole and a vertical slot extending from said central hole, so that said sponge member can be placed between said cover and said container, about one said elongate arbor bar to hold the grease and apply the grease to said elongate arbor bar, when said improved counterweight arbor carriage moves up and down.

* * * * *